US007445470B2

(12) United States Patent
Shen et al.

(10) Patent No.: US 7,445,470 B2
(45) Date of Patent: Nov. 4, 2008

(54) ELECTRICAL CONNECTOR WITH IMPROVED HOUSING

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 43 days.

(21) Appl. No.: 11/580,609

(22) Filed: Oct. 12, 2006

(65) Prior Publication Data

US 2007/0087595 A1 Apr. 19, 2007

(30) Foreign Application Priority Data

Oct. 13, 2005 (CN) ..... 2005 2 0076411 U

(51) Int. Cl.
*H01R 4/66* (2006.01)

(52) U.S. Cl. ..... 439/101; 439/607

(58) Field of Classification Search ..... 439/79, 439/108, 607, 637
See application file for complete search history.

(56) References Cited

U.S. PATENT DOCUMENTS 5,035,631 A * 7/1991 Piorunneck et al. ..... 439/108
6,315,616 B1 * 11/2001 Hayashi ..... 439/638
6,890,193 B2 5/2005 Kimura et al.
6,913,488 B2 * 7/2005 Motojima et al. ..... 439/607
7,229,315 B2 * 6/2007 Zhang et al. ..... 439/607

FOREIGN PATENT DOCUMENTS

TW 504870 10/2002

* cited by examiner

*Primary Examiner*—Tho D. Ta
*Assistant Examiner*—Travis Chambers
(74) *Attorney, Agent, or Firm*—Wei Te Chung

(57) ABSTRACT

An electrical connector (100) comprises an insulated housing (10), a plurality first contacts (40) and second contacts (30) retained in the insulated housing and a metallic shell (20) assembled to surround the insulated housing. The insulated housing has a base (112), a top wall (110) and a bottom wall (111). The top wall and bottom wall extend from the base in a front-to-back direction and are arranged oppositely to each other to form a receiving space (170) therebetween. The bottom wall of the insulated housing has a plurality of channels (114) extending therethough in a vertical direction perpendicular to the front-to-back direction for receiving the second contacts therein and a plurality of rib portions (118) each respectively located between every two adjacent channels.

15 Claims, 7 Drawing Sheets

ELECTRICAL CONNECTOR WITH IMPROVED HOUSING

BACKGROUND OF THE INVENTION

1. Field of the Invention

The present invention generally relates to an electrical connector, and more particularly to a connector for connecting a printed circuit board (PCB) to a flexible circuit board (FPC) or a flexible flat cable (FFC).

2. Description of Related Art

Electrical connectors are widely used for signal or power transmission between electronic elements. Such an electrical connector generally has an insulated housing, a plurality of contacts arranged side by side to be retained in the housing and a metallic shell mounted to the housing for protecting the contacts from unexpectable electromagnetic interference. Said contacts are divided into signal contacts and grounding contacts, and the grounding contacts are usually arranged to electrically connect with the metallic shell to form a grounding route.

A similar electrical connector is disclosed in U.S. Pat. No. 6,315,616. The electrical connector comprises an insulated housing having a base extending along a longitudinal direction and a top wall integrally extending from an upper portion of a front surface of the base, a plurality of signal contacts and a grounding contact retained in the base. Each signal contact comprises a contact portion extending forwardly along the top wall of the housing and a solder portion opposite to the contact portion and extending beyond the base for connecting onto a PCB. The grounding contact has a main plate, a plurality of contact portions extending from a lower edge of the main plate along said contact portions of the signal contacts to form a mating space therebetween and a plurality of solder legs also extending from the lower edge to be located among said solder portions for electrically connecting with a grounding circuit of the PCB.

The electrical connector further comprises a metallic shell surrounding around the outer of housing. The top wall acts as one wall of the mating space, and the metallic shell acts as the other wall of the mating space so that make the electrical connector in a small size. However, when a complementary connector is inserted into the mating space, the metallic shell is prone to distort due to its physical property. In addition, the grounding contact has many solder legs among the solder portion of the signal contact resulting in decreasing the space for accommodating the solder portions and restricting the amount of signal contacts.

Hence, an improved electrical connector is highly desired.

SUMMARY OF THE INVENTION

Accordingly, an object of the present invention is to provide an electrical connector which is hardly distorted when the electrical connector mating with a complementary connector.

In order to achieve the object set forth, an electrical connector in accordance with the present invention comprises an insulative housing having a base, a top wall and a bottom wall, and said top wall and bottom wall both extending from the base in a front-to-back direction and located oppositely to each other to form a receiving space therebetween; a plurality first contacts and second contacts retained in the insulated housing; a metallic shell assembled to surround the insulated housing. The bottom wall of the insulated housing has a plurality of channels extending therethough in a vertical direction perpendicular to the front-to-back direction for receiving the second contacts therein and a plurality of rib portions each respectively located between every two adjacent channels.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
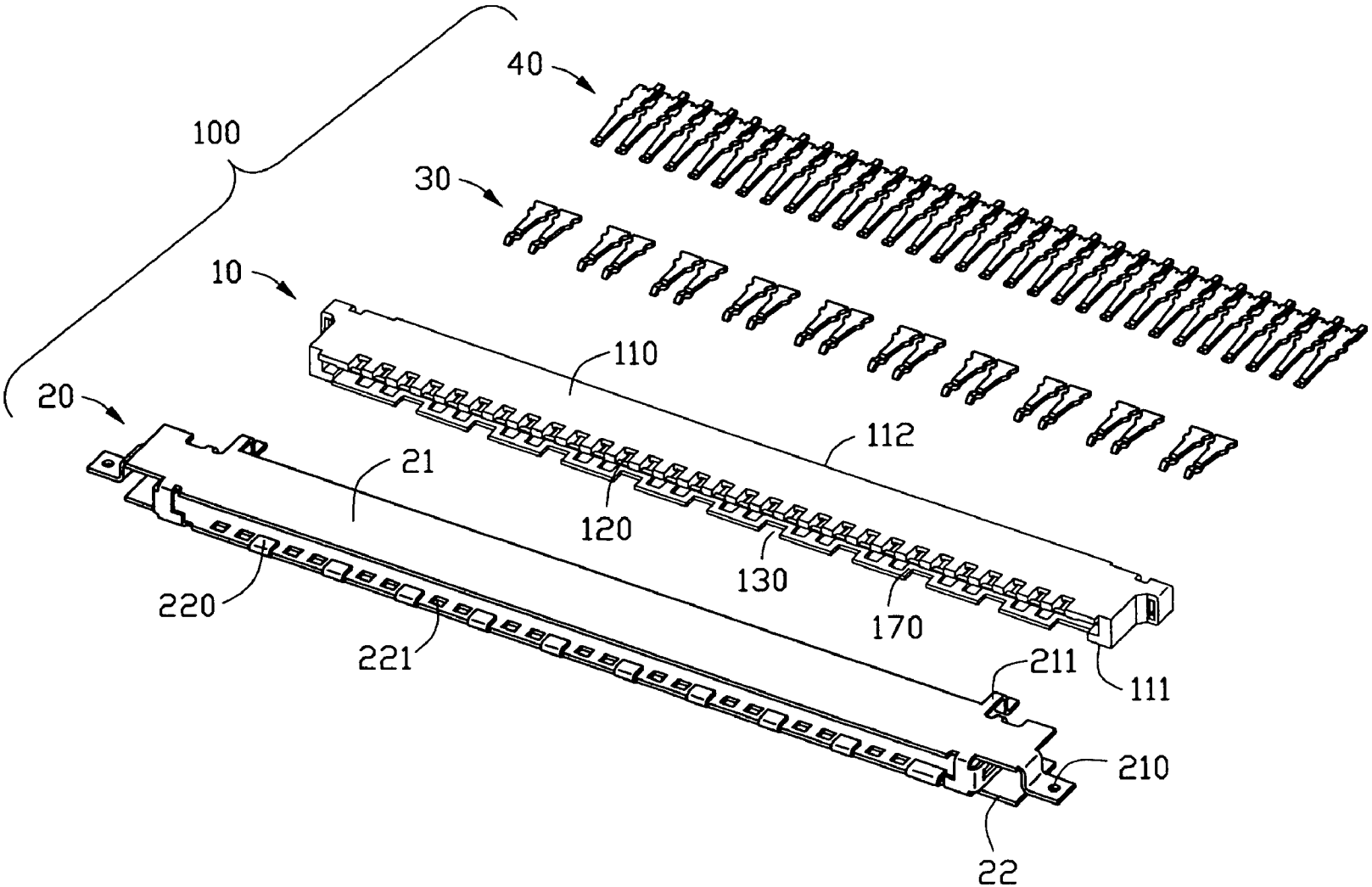
FIG. 1 is an exploded, perspective view of an electrical connector in accordance with the present invention.
Figure 2:
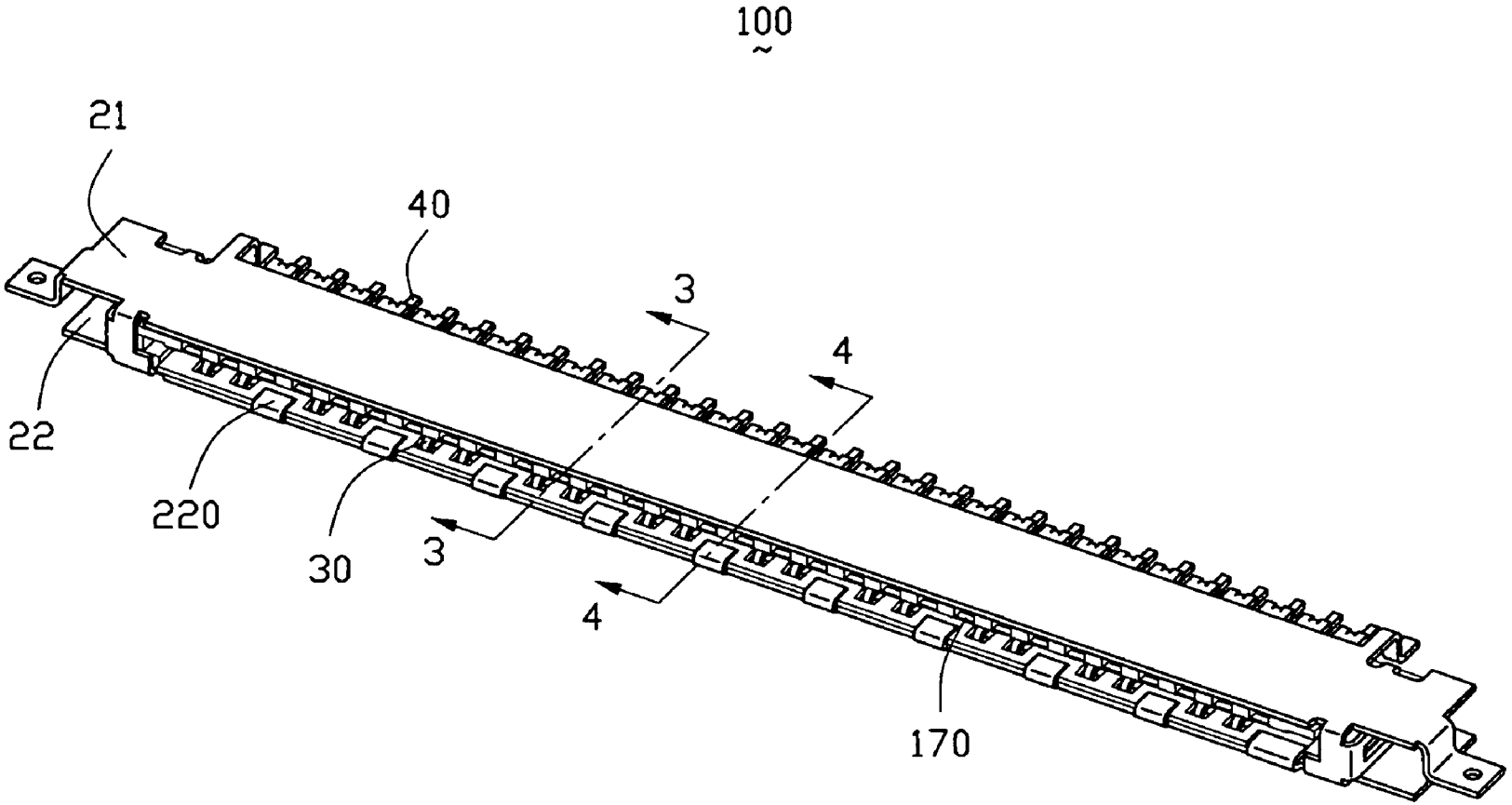
FIG. 2 is an assembled, perspective view of the electrical connector.

Referring to FIG. 1 and FIG. 2, an electrical connector 100 in accordance with the present invention comprises an insulated housing 10, a metallic shell 20 arranged to surround the housing 10, a plurality of first contacts 40 and second contacts 30 which are retained in the housing 10. In this embodiment, the first contacts 40 used for transmitting signals are defined as signal contacts, and the second contacts 30 used for grounding are defined as grounding contacts.

Figure 3:
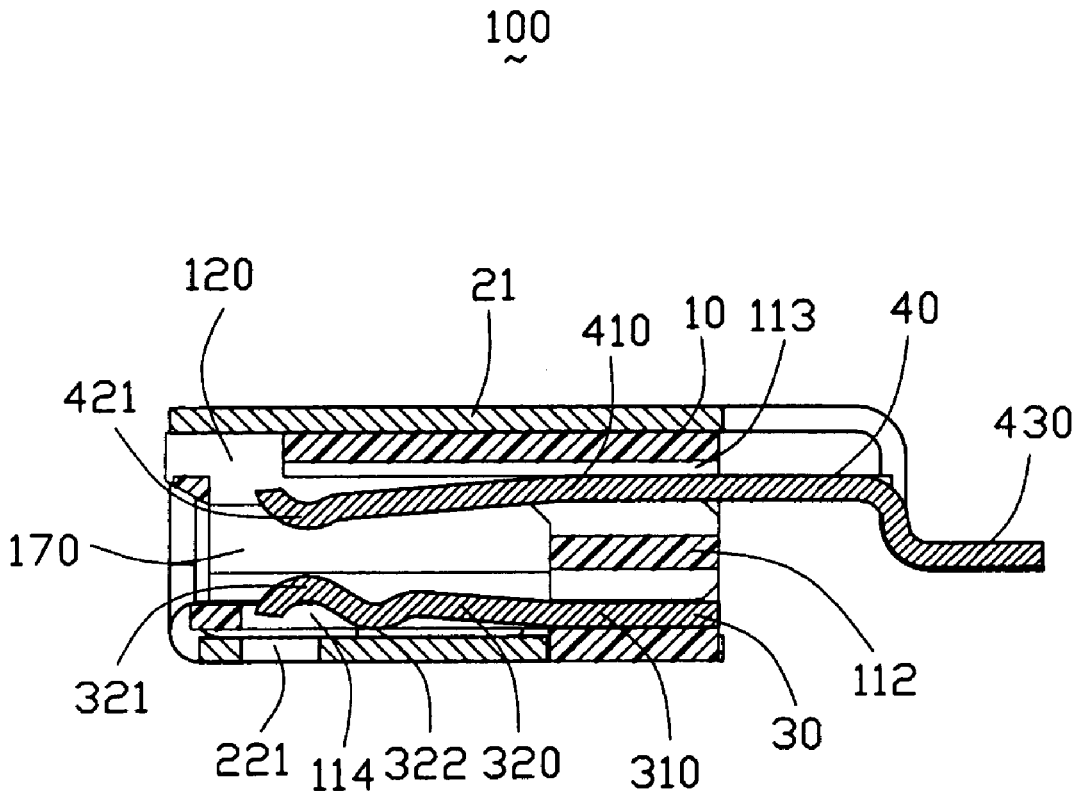
FIG. 3 is a cross-sectional view of the electrical connector taken along line 3-3 of FIG. 2.
Figure 4:
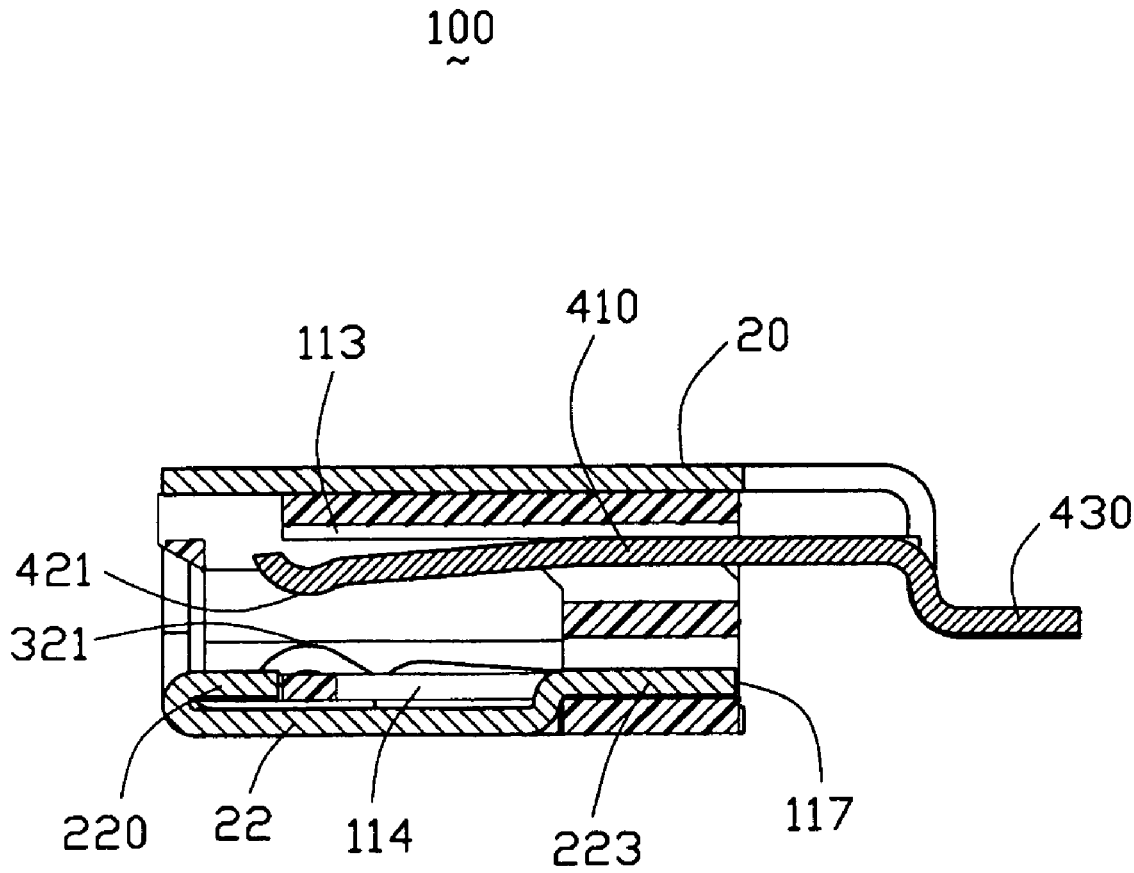
FIG. 4 is another cross-sectional view of the electrical connector taken line 4-4 of FIG. 2.
Figure 7:
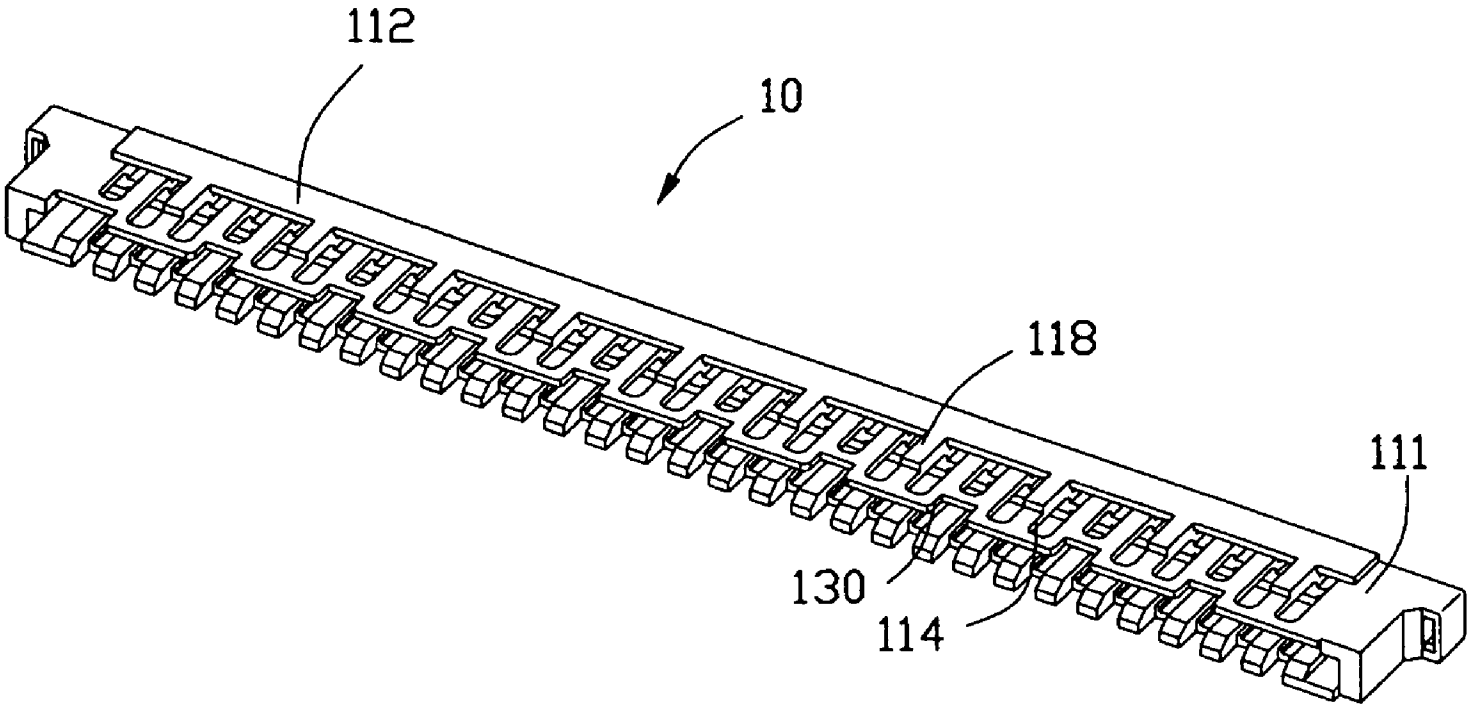
FIG. 7 is perspective view of an insulated housing of the electrical connector.

Referring to FIGS. 1, 3 and 7, the insulated housing 1 is substantially elongated and comprises a base 112 extending along a longitudinal direction and a mating portion extending forward from a front surface of the base 112 along a front-to-back direction perpendicular to the longitudinal direction. The mating portion has a mating space 170 surrounded by a top wall 110, a bottom wall 111 spaced oppositely to the top wall 110 and a pair of transverse walls connecting the top and bottom wall 110, 111 together for accommodating a complementary connector 50 therein. The base 112 comprises a plurality of passageways 117 at a lower portion thereof. The top wall 110 has a plurality of receiving grooves 113 communication with the receiving space 170 at inner surface thereof and extending through an upper portion of the base 112. The bottom wall 111 has a plurality of short and long channels 114 extending therethrough in a vertical direction perpendicular to the longitudinal direction and the front-to-back direction and arranged in a one-two style along the longitudinal direction. In addition, the bottom wall 111 further defines a plurality of cutouts 130 at front end thereof and each of which aligns with corresponding the short channels 114 in the front-to-back direction and a plurality of rib portions 118 formed between every two adjacent long channels 114. Each rib portion 118 has a bottom surface coplanar with that of the base 112.

Referring to FIG. 3, each signal contact 40 comprises a fixed portion 410 retained in the base 112, a connecting portion 430 extending rearward from the fixed portion 410 to electrically connect to a printed circuit board and a contact portion 421 extending forward from the fixed portion 410 along the top wall 110 to be received in the corresponding receiving grooves 113. As long as the connecting portion 430 electrically connect with the printed circuit board, operators can adopt any technology such as Though Hole Technology or Surface Mounted Technology. Each grounding contact 30 comprises a fixed portion 310 retained in the base 112 and a resilient arm 320 extending forward from the fixed portion to be received in the corresponding long channels 114. The resilient arm 320 has a first contact portion 321 and a second contact portion 322 which spaced from the first contact portion 321 in the front-to-back direction. The first contact portion 321 curves toward the receiving space 170 to expose into the receiving space 170 and opposite to the contact portion 421 of the signal contact 40. The second contact portion 322 is located behind the first contact portion 322 and curves oppositely to the first contact portion 321. Although the bottom wall 111 is added relative to prior arts to obtain a firm mating portion, the entire height of the electrical connector 100 is not increased for the grounding contacts 30 are received in the long channels 114 of the bottom wall 111. The grounding contacts 30 do not extending beyond the base 112 to make more space of the printed circuit board for accommodating the connecting portions 430 of the signal contacts 40. In other wards, the housing 10 can retain more signal contacts 40 therein under a changeless size of the housing condition and meet the tendency of miniaturization of electrical connectors.

Referring to 1, 3, 4 and 6, the metallic shell 20 has a top plate 21 used for covering the top wall 110 of the housing 10, a bottom plate 22 used for covering the bottom wall 111 of the housing 10 and a pair of vertical plates connecting the top plate 21 and the bottom plate 22 together. The top plate 21 has a pair of solder pads 210 extending from corresponding lateral sides thereof and a pair of connecting legs 211 extending rearward to be located beside the connecting portions 430 of the signal contacts 40. The solder pads 210 and the connecting legs 211 all electrically connect to grounding routes of the printed circuit board. The bottom plate 22 has a plurality of bent portions 220 bending from a front edge thereof and toward the base 112 to be received in the corresponding cutouts 130 of the bottom wall 111 and a plurality of opening 221 extending therethrough in the vertical direction. The bent portions 220 can guide the complementary connector inserted into the receiving space 170. The openings 221 align with the first contact portions 321 of the grounding contacts 30 in the vertical direction so as to provide enough space for the first contact portions 321 when the grounding contacts 30 is urged to move downward. The bottom plate 22 further comprises a plurality of fixed tabs 223 extending from rear edge thereof and a plurality of slots used for accommodating the rib portions 118. When the metallic shell 20 is mounted to the housing 10, the fixed tabs 233 are inserted into corresponding passageways 117 of the housing 10 so as to firmly assemble the metallic shell 20 to the insulated housing 10.

The height of each rib portion 118 is substantially similar to the thickness of the bottom plate 22, thus, bottom surfaces of rib portions 118, bottom plate 22 and the base 112 are in the same plane after the metallic shell 20 completely assembled onto the housing 10. As a result, the electrical connector 100 has a substantially flat bottom surface.

Figure 5:
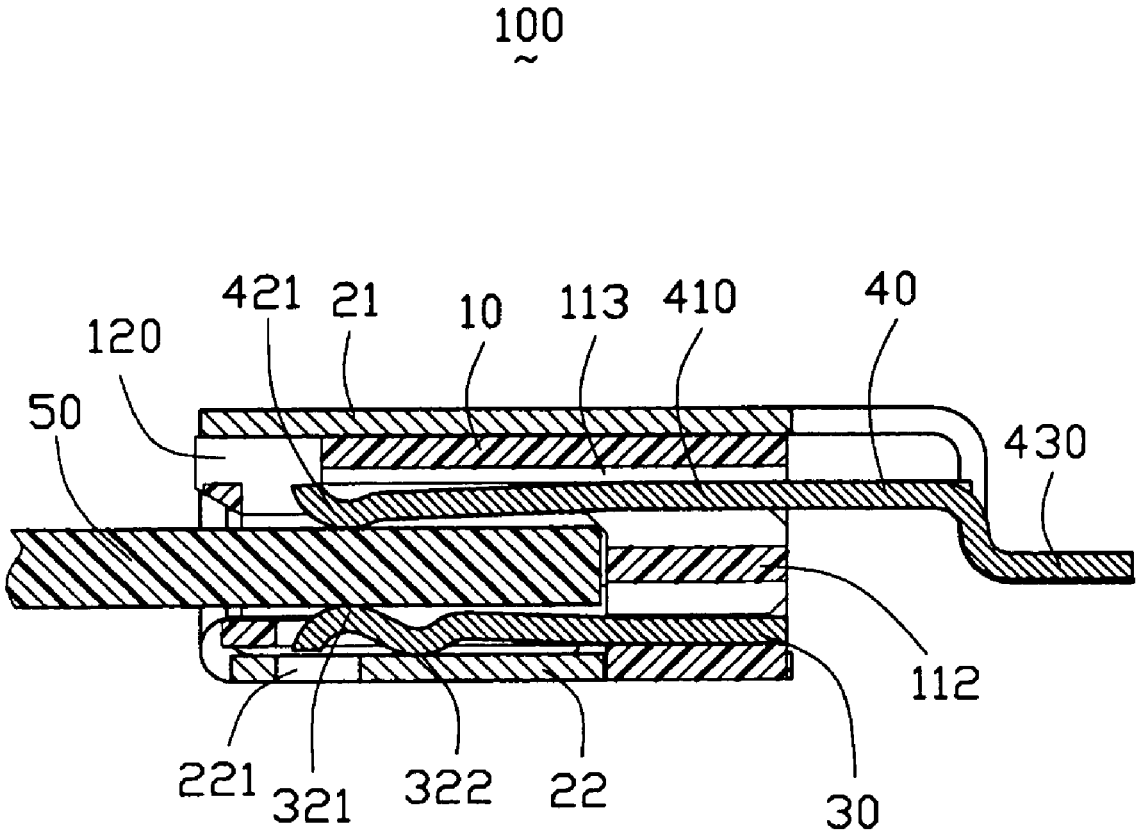
FIG. 5 is a similar view of FIG. 3, intending to show the mating status between a complementary connector and the electrical connector.
Figure 6:
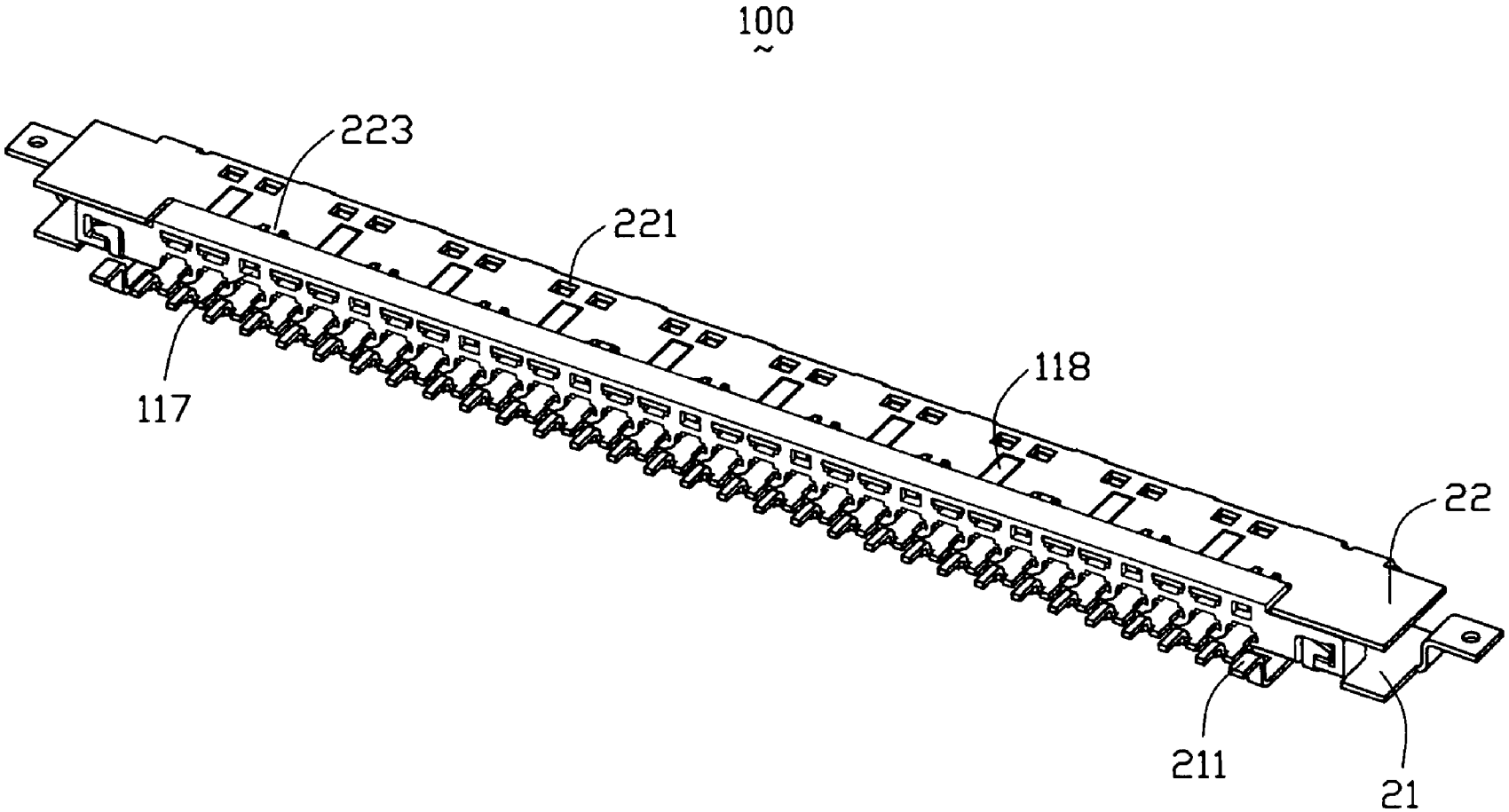
FIG. 6 is a similar view of FIG. 2, but taken from another aspect.

Before the complementary connector being inserted into the electrical connector 100, the second contact portions 322 of the grounding contacts 30 space from the bottom plate 22 of the metallic shell 20. Further referring to FIG. 5, when the complementary connector is inserted into the electrical connector 100, the complementary connector is electrically mating with the signal contacts 40 and the first contact portions 321 of the grounding contacts 30, and then the resilient arm 320 is urged to move toward the bottom plate 22. Finally, the second contact portions 322 of the resilient arm 320 electrically and mechanically contact with the bottom plate 22 to form a continued grounding route. The top plate 21 further comprises a plurality of openings 120 align with the contact portions 421 of the signal contacts 40. The openings 120, 221 provide enough space for accommodating the signal contacts 40 and the grounding contacts 30 during assembling so as to decrease the entire height of the electrical connector 100.

Referring to FIG. 7, in order to improve the intensity of the mating portion and decrease the distortion of the metallic shell 20 , the bottom wall 111 is added. Generally, the bottom wall 111 is very thin in order to satisfy the miniaturization requirement. The rib portions 118 defined on the bottom wall 111 not only improve the intensity of housing 10 but also optimize the injecting molding process of the housing 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulated housing having a base, a top wall and a bottom wall, and said top wall and bottom wall extending from the base in a front-to-back direction and located oppositely to each other to form a receiving space therebetween;

a plurality of contacts retained in the insulated housing;

a metallic shell assembled to surround the insulated housing, the metallic shell comprising a bottom plate covering the bottom wall of the insulated housing and defining a plurality of slots; and wherein the bottom wall of the insulated housing has a plurality of channels extending therethrough in a vertical direction perpendicular to the front-to-back direction to receive some of said contacts therein and a plurality of rib portions respectively located between every two adjacent channels, the rib portions integrally project down from the bottom wall so as to cooperate with the slots of the shell.

2. The electrical connector as claimed in claim 1, wherein the rib portion extends in the front-to-back direction at a bottom surface of the bottom wall.

3. The electrical connector as claimed in claim 1, wherein the bottom plate of the metallic shell and the rib portions are in a same plane.

4. The electrical connector as claimed in claim 1, wherein the bottom plate has a plurality of bent portions bending from a front edge thereof and toward the base, and the bottom wall of the insulated housing defines a plurality of cutouts for receiving the corresponding bent portions therein.

5. The electrical connector as claimed in claim 1, wherein the metallic shell further comprises a top plate covering the top wall of the insulated housing and a connecting portion extending from the top plate for electrically connecting to a printed circuit board.

6. The electrical connector as claimed in claim 1, wherein said contacts are divided into first contacts retained in top wall of the insulated housing and second contacts retained in bottom wall of the insulated housing.

7. The electrical connector as claimed in claim 6, wherein the first contact comprises a contact portion exposed into the receiving space, a fixed portion extending rearward from the contact portion and fixed in the base and a connecting portion extending forward from the fixed portion and beyond the base for electrically connecting to a printed circuit board, and the second contact comprises a fixed portion fixed in the base and a resilient arm extending forward from the fixed portion to be received in the channels.

8. The electrical connector as claimed in claim 7, wherein the resilient arm comprises a first contact portion curves toward the receiving space and a second contact portion spaced from the first contact portion in the front-to-back direction.

9. The electrical connector as claimed in claim 8, wherein the second contact portion curves oppositely to the first contact portion and electrically contacting with the metallic shell when a complementary connector is inserted into the receiving space.

10. The electrical connector as claimed in claim 9, wherein the metallic shell defines a plurality of openings corresponding to the contact portions of the first contacts and the first contact portions of the second contacts.

11. An electrical connector comprising:

an insulated housing having a base, opposite firs and second side walls, and said first and second side walls extending from the base in a front-to-back direction and commonly forming a receiving space therebetween;

a plurality of contacts retained in the insulated housing around the first side wall and extending into the receiving space; and a metallic shell assembled to the insulated housing and covering both the first side wall and the second side wall; wherein the second side walls of the insulated housing has a plurality of channels extending therethrough in a vertical direction perpendicular to the front-to-back direction to receive a plurality of resilient deflectable grounding contacts being bidden behind the shell; wherein said second side wall defines a step structure and the shell is received in a space defined by the step; wherein the shell defines a plurality of fixing tabs in an offset manner so as to be hidden behind the step structure of the second side wall; wherein said step structure includes an elongated bar extending along a rear edge region of the second side wall in along a longitudinal direction perpendicular to both said front-to-back direction and said vertical direction, and defining along said longitudinal direction a dimension similar to that of the receiving space; wherein a plurality of spaced ribs unitarily extends forwardly from the elongated bar in a coplanar manner for reinforcing the housing.

12. The connector as claimed in claim 11, wherein said grounding contacts are mechanically and electrically engaged with the shell when a plate-like electronic component is inserted into the receiving space.

13. The connector as claimed in claim 11, wherein said shell defines a plurality of opening to receive tip regions of the corresponding grounding contacts when said plate-like electronic component is inserted into the receiving space.

14. The electrical connector as claimed in claim 11, wherein each rib portion connects with the bottom wall, and the bottom face of the rib portions are not coplanar with that of the bottom wall.

15. An electrical connector comprising:

an insulating housing comprising a base with a top and bottom face, opposite top and bottom walls extending forward from the base and commonly forming a receiving cavity, and a plurality of spaced rib portions extending forward from the base therewith a bottom face aligned with the bottom face of the base;

a plurality of contacts retained in the housing and extending into the receiving cavity; and a metallic shell comprising a top and bottom plates covering the top and bottom walls of the housing respectively, and therein a plurality of the slots communicating with the rib portions to expose the rib portions to an exterior, the bottom plate of the shell and the base being in a same plane.

* * * * *